US008674905B2

(12) United States Patent
Eom et al.

(10) Patent No.: US 8,674,905 B2
(45) Date of Patent: Mar. 18, 2014

(54) SCAN DRIVER, LIGHT EMITTING DISPLAY USING THE SAME, AND DRIVING METHOD THEREOF

(75) Inventors: Ki Myeong Eom, Suwon (KR); Choon Yul Oh, Gunpo (KR)

(73) Assignee: Samsung Display Co., Ltd., Yongin-si (KR)

( * ) Notice: Subject to any disclaimer, the term of this patent is extended or adjusted under 35 U.S.C. 154(b) by 1397 days.

(21) Appl. No.: 11/256,665

(22) Filed: Oct. 21, 2005

(65) Prior Publication Data

US 2006/0103323 A1 May 18, 2006

(30) Foreign Application Priority Data

Oct. 28, 2004 (KR) ..... 10-2004-0086915

(51) Int. Cl.
*G09G 3/30* (2006.01)

(52) U.S. Cl.
USPC ..... 345/76; 345/98; 345/99

(58) Field of Classification Search
USPC ..... 345/76, 77, 204, 98
See application file for complete search history.

(56) References Cited

U.S. PATENT DOCUMENTS

| | | | | |
|---|---|---|---|---|
| 2002/0196389 | A1 | 12/2002 | Koyama | |
| 2003/0107560 | A1 | 6/2003 | Yumoto et al. | |
| 2003/0142509 | A1 | 7/2003 | Tsuchiya et al. | |
| 2004/0113873 | A1* | 6/2004 | Shirasaki et al. | 345/76 |
| 2004/0246208 | A1* | 12/2004 | Machida | 345/76 |
| 2004/0263506 | A1* | 12/2004 | Koyama et al. | 345/204 |
| 2005/0083768 | A1* | 4/2005 | Hara | 365/232 |
| 2006/0103323 | A1* | 5/2006 | Eom et al. | 315/169.3 |
| 2007/0115223 | A1 | 5/2007 | Kimura | |
| 2009/0251456 | A1 | 10/2009 | Koyama | |
| 2010/0097410 | A1 | 4/2010 | Ozawa et al. | |

FOREIGN PATENT DOCUMENTS

| | | |
|---|---|---|
| CN | 1402211 | 3/2003 |
| CN | 1497514 | 5/2004 |
| EP | 1 424 674 A1 | 6/2004 |
| JP | 2001-324958 | 11/2001 |

(Continued)

OTHER PUBLICATIONS

European Search Report dated Jan. 18, 2006 for European Application 05109982.8 in the name of Samsung SDI Co., Ltd., corresponding to Korean priority KR 2004-86915.

(Continued)

*Primary Examiner* — William Boddie
*Assistant Examiner* — Leonid Shapiro
(74) *Attorney, Agent, or Firm* — Christie, Parker & Hale, LLP

(57) ABSTRACT

A light emitting display including: a plurality of scan lines adapted to transmit scan signals; a plurality of data lines adapted to transmit a data signal; a plurality of emission control lines adapted to transmit an emission control signal; and a plurality of pixels adapted to emit light in response to the scan signal, the data signal and the emission control signal. At least two pixels receiving the scan signals through different scan lines are connected to one emission control line. With this configuration, a scan driver and a light emitting display including the same have a decreased number of wiring lines provided in a pixel portion, thereby enhancing an aperture ratio, decreasing the number of emission control signals, decreasing the number of components and wiring lines needed for the scan driver, simplifying a fabrication process, and reducing the power consumption of the light emitting display.

5 Claims, 13 Drawing Sheets

(56) References Cited

FOREIGN PATENT DOCUMENTS

| | | | |
|---|---|---|---|
| JP | 2002-149112 | A | 5/2002 |
| JP | 2003-084314 | | 3/2003 |
| JP | 2003-255899 | | 9/2003 |
| JP | 2003-332910 | | 11/2003 |
| JP | 2004-117921 | | 4/2004 |
| JP | 2004-139091 | | 5/2004 |
| JP | 2004-181655 | A | 7/2004 |
| JP | 2004-191574 | | 7/2004 |
| WO | WO 03/038790 | A2 | 5/2003 |
| WO | WO 03/038790 | A3 | 5/2003 |
| WO | WO 03/054845 | A1 | 7/2003 |

OTHER PUBLICATIONS

Choi S.M., et al., *A Self-compensated Voltage Programming Pixel Structure for Active-Matrix Organic Light Emitting Diodes*, IDW. Proceedings of the International Display Workshops, 2003, pp. 535-538, XP008057381.

SIPO Patent Gazette dated Dec. 17, 2008, for corresponding Chinese application 200510116875.9, noting listed references in this IDS.

Patent Abstracts of Japan for Japanese Publication No. 2002-149112, published on May 24, 2002 in the name of Koyama Jun.

Patent Abstracts of Japan for Japanese Publication No. 2004-181655, published on Jul. 2, 2004 in the name of Sato Masataka et al.

Japanese Office action dated Apr. 7, 2009, for corresponding Japanese application 2005-162294, noting listed reference in this IDS, as well as JP 2002-149112, previously filed in an IDS dated Jul. 21, 2008.

Japanese Office action dated Dec. 13, 2011, for corresponding Japanese Patent application 2008-218322, noting listed references in this IDS, 4 pages.

JPO Office action dated Jun. 18, 2013, for corresponding Japanese Patent application 2008-218322, (3 pages).

EPO Office action dated Jul. 12, 2013, for corresponding European Patent application 05109982.8, (7 pages).

* cited by examiner

SCAN DRIVER, LIGHT EMITTING DISPLAY USING THE SAME, AND DRIVING METHOD THEREOF

CROSS-REFERENCE TO RELATED APPLICATIONS

This application claims priority to and the benefit of Korean Patent Application No. 10-2004-0086915, filed on Oct. 28, 2004, in the Korean Intellectual Property Office, the entire content of which is incorporated herein by reference.

BACKGROUND

1. Field of the Invention

The present invention relates to a scan driver, a light emitting display including the same, a driving method thereof, and more particularly, to a scan driver, a light emitting display including the same, and a driving method thereof, in which the number of wiring lines is decreased, and the number of output lines connected to a scan driver is decreased, thereby enhancing an aperture ratio and reducing power consumption.

2. Discussion of Related Art

Recently, various flat panel displays have been developed to replace cathode ray tube (CRT) displays because the CRT displays are relatively heavy and bulky. Among the flat panel displays, a light emitting display is notable because it has high emission efficiency, high brightness, a wide viewing angle, and a fast response time.

The light emitting display includes a plurality of light emitting devices, wherein each light emitting device has a structure in which an emission layer is placed between a cathode electrode and an anode electrode. Here, electrons and holes are injected into the emission layer and recombined to create excitons, and light is emitted when an exciton falls to a lower energy level.

Such a light emitting display is classified into an inorganic light emitting display including an inorganic emission layer, and an organic light emitting display including an organic emission layer.

FIG. 1 is a circuit diagram of a pixel provided in a conventional light emitting display. Referring to FIG. 1, four pixels are adjacent to each other, and each pixel includes a light emitting device (e.g., organic light emitting diode (OLED)) and a pixel circuit. The pixel circuit includes a first transistor M1, a second transistor M2, a third transistor M3, and a capacitor Cst. Here, each of the first through third transistors M1, M2 and M3 has a gate, a source and a drain; and the capacitor Cst has a first electrode and a second electrode.

Every pixel has the same configuration, and thus a top left pixel will be exemplarily described hereinbelow. The first transistor M1 includes the source connected to a power line Vdd, the drain connected to the source of the third transistor M3, and the gate connected to a first node A. The first node A is connected to the drain of the second transistor M2. Here, the first transistor M1 supplies current corresponding to the data signal to the light emitting device OLED.

The second transistor M2 includes the source connected to a data line D1, the drain connected to the first node A, and the gate connected to a first scan line S1. Here, the second transistor M2 receives a first selection signal through its gate and supplies the data signal to the first node A.

The third transistor M3 includes the source connected to the drain of the first transistor M1, the drain connected to an anode electrode of the light emitting device OLED, and the gate connected to an emission control line E1 to respond to an emission control signal. Here the third transistor M3 controls the current flowing from the first transistor M1 to the light emitting device OLED in response to the emission control signal, thereby controlling the light emitting device OLED to emit light.

The capacitor Cst includes the first electrode connected to the power line Vdd, and the second electrode connected to the first node A. Here, the capacitor Cst stores electric charges corresponding to the data signal, and supplies a signal based on the stored electric charges to the gate of the first transistor M1 for one frame, thereby maintaining an operation of the first transistor M1 for one frame.

However, in the pixel provided in the conventional light emitting display, the emission control lines are connected to pixel rows, respectively. Therefore, the number of wiring lines is proportional to the number of emission control lines, thereby deteriorating an aperture ratio.

Further, in this case, the scan driver outputs the emission control signal to the plurality of emission control lines, and therefore, the number of output lines connected to the scan driver increases in proportion to the number of emission control lines, thereby increasing the number of components provided in the scan driver. Therefore, the power consumption increases in the scan driver. Further, the size of the scan driver is increased, thereby wastefully occupying much space of the light emitting display.

SUMMARY OF THE INVENTION

Accordingly, it is an aspect of the present invention to provide a scan driver, a light emitting display including the same, and a driving method thereof, in which the number of emission control lines is decreased to enhance an aperture ratio, and thus the number of signals outputted from the scan driver is also decreased, thereby making fabrication thereof easy and reducing power consumption.

An exemplary embodiment according to the present invention provides a light emitting display including: a plurality of scan lines adapted to transmit scan signals; a plurality of data lines adapted to transmit a data signal; a plurality of emission control lines adapted to transmit an emission control signal; and a plurality of pixels adapted to emit light in response to the scan signals, the data signal and the emission control signal, a luminosity of the light being varied to represent different gray scales in accordance with a magnitude of the data signal, wherein at least two of the plurality of pixels that receive the scan signals through different scan lines among the plurality of scan lines are coupled to one emission control line among the plurality of emission control lines.

Another exemplary embodiment according to the present invention provides a light emitting display including: a plurality of scan lines adapted to transmit scan signals; a plurality of data lines adapted to transmit a data signal; a plurality of emission control lines adapted to transmit an emission control signal; and a plurality of pixels adapted to emit light in response to the scan signals, the data signal and the emission control signal, wherein at least two of the plurality of pixels that receive the scan signals through different scan lines among the plurality of scan lines emit light in response to one emission control signal transmitted through different emission control lines among the plurality of emission control signals.

Yet another exemplary embodiment according to the present invention provides a light emitting display including: a plurality of scan lines adapted to transmit scan signals; a plurality of data lines adapted to transmit a data signal; a plurality of emission control lines adapted to transmit an emission control signal; and a plurality of pixels adapted to emit light in response to the scan signals, the data signal and the emission control signal, wherein the plurality of pixels include a first pixel for receiving a first scan signal and a second scan signal among the scan signals, and a second pixel for receiving the second scan signal and a third scan signal among the scan signals, wherein the first and second pixels are coupled to a same one of the emission control lines.

Yet another exemplary embodiment according to the present invention provides a light emitting display including: a plurality of scan lines adapted to transmit scan signals; a plurality of data lines adapted to transmit a data signal; a plurality of emission control lines adapted to transmit emission control signals; and a plurality of pixels adapted to emit light in response to the scan signals, the data signal and the emission control signals, wherein the plurality of pixels include a first pixel for receiving a first scan signal and a second scan signal among the scan signals, and a second pixel for receiving the second scan signal and a third scan signal among the scan signals, wherein the first and second pixels emit light in response to one of the emission control signals, which is transmitted through different ones of the emission control lines.

Yet another exemplary embodiment according to the present invention provides a scan driver including: a shift register adapted to shift an input starting signal and output a plurality of shift signals to a plurality of output lines in sequence; a plurality of first operators coupled to the plurality of output lines of the shift register and for using the shift signals to generate scan signals; and a plurality of second operators coupled to the plurality of output lines of the shift register and for generating the scan signals and emission control signals by using the shift signals.

Yet another exemplary embodiment according to the present invention provides a method of driving a light emitting display, including: transmitting a scan signal to a first pixel row including a plurality of pixels coupled to a first scan line; transmitting another scan signal to a second pixel row including a plurality of pixels coupled to a second scan line adjacent to the first scan line; and allowing the first pixel row and the second pixel row to emit light at substantially the same time in response to a same emission control signal transmitted to the first and second pixel rows. The luminosity of the light is varied to represent different gray scales in accordance with magnitudes of data signals respectively provided when the scan signal and the another scan signal are transmitted.

Yet another exemplary embodiment according to the present invention comprises a method of driving a light emitting display, including: transmitting a first scan signal to a first pixel row including a plurality of pixels coupled to a first scan line; transmitting a second scan signal to the first pixel row, and transmitting the second scan signal to a second pixel row including another plurality of pixels coupled to a second scan line adjacent to the first scan line; transmitting a third scan signal to the second pixel row; and allowing the first pixel row and the second pixel row to emit light at substantially the same time in response to a same emission control signal transmitted to the first and second pixel rows.

BRIEF DESCRIPTION OF THE DRAWINGS

These and/or other features and aspects of the present invention will become apparent and more readily appreciated from the following description of exemplary embodiments, taken in conjunction with the accompanying drawings of which.

DETAILED DESCRIPTION

Figure 1:
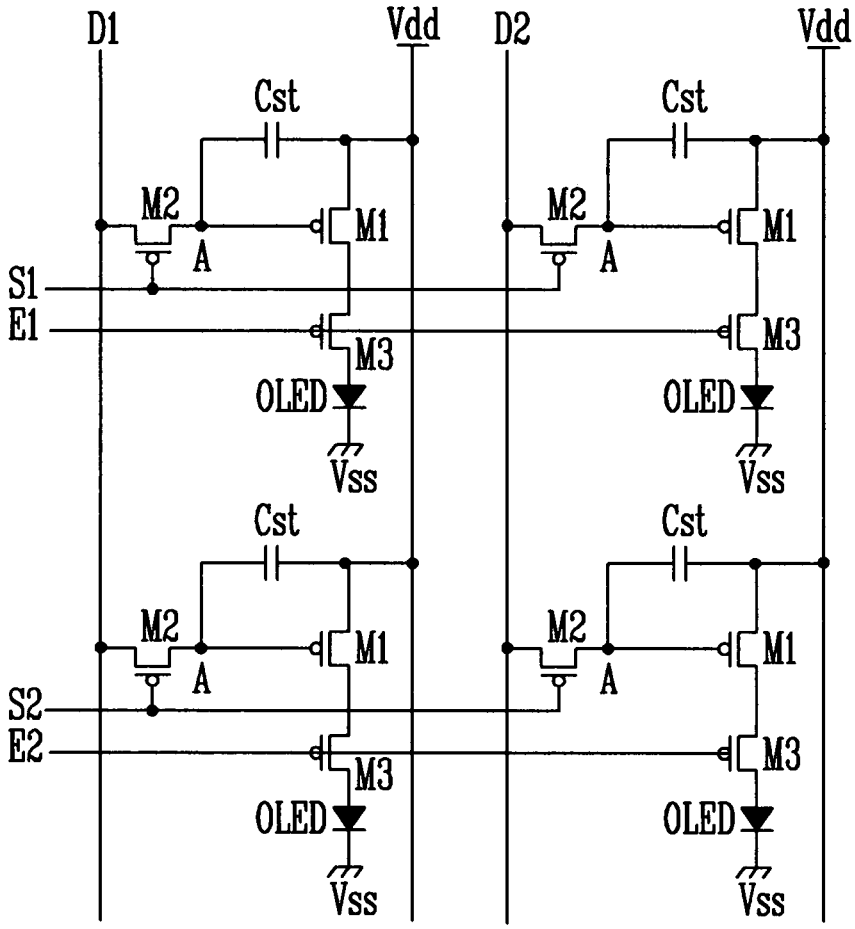
FIG. 1 (PRIOR ART)
FIG. 1 is a circuit diagram of pixels provided in a conventional light emitting display.

Hereinafter, certain exemplary embodiments according to the present invention will be described with reference to the accompanying drawings. Herein, when one element is described as being connected to another element, it may mean that the one element is directly connected to another element or that the one element is indirectly connected to another element via a third element. There may be parts shown in the drawings, or parts not shown in the drawings, that are not discussed in the specification as they are not essential to a complete understanding of the invention. Like reference numerals designate like elements throughout the drawings and the specification.

Figure 2:
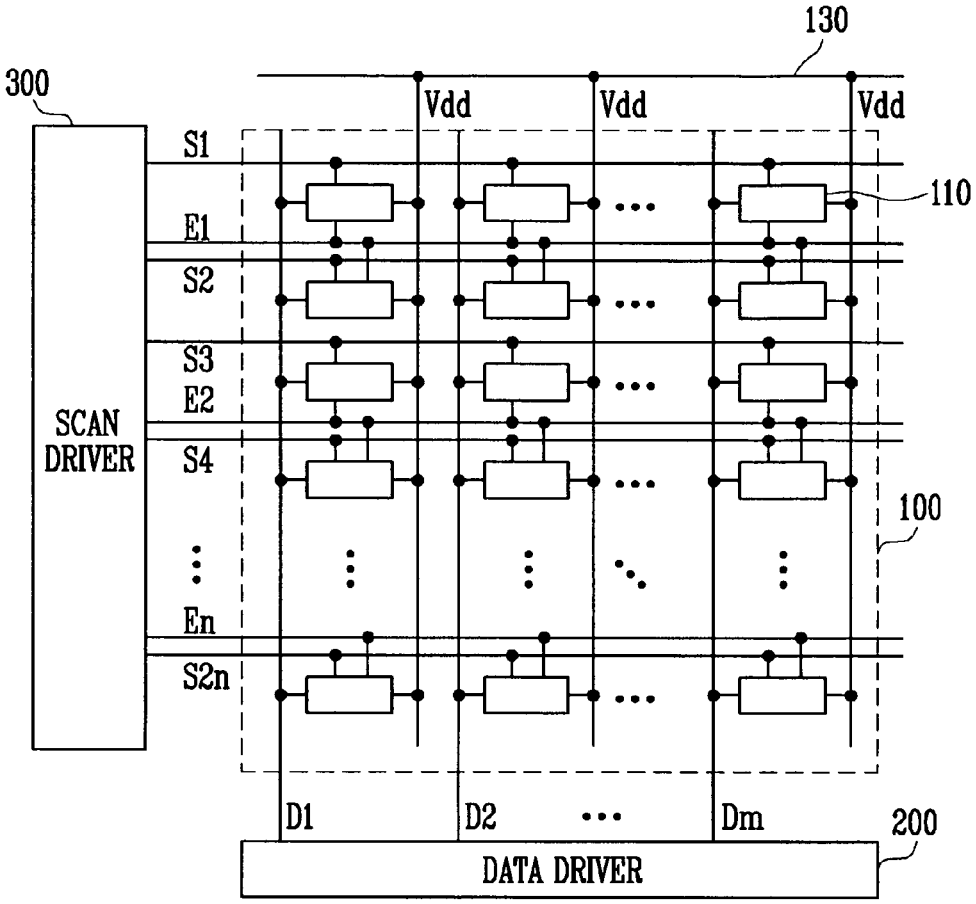
FIG. 2 illustrates a configuration of a light emitting display according to a first exemplary embodiment of the present invention.

FIG. 2 illustrates a configuration of a light emitting display according to a first exemplary embodiment of the present invention. Referring to FIG. 2, a light emitting display according to the first exemplary embodiment of the present invention includes a pixel portion 100, a data driver 200, and a scan driver 300.

The pixel portion 100 includes a plurality of pixels 110 each including light emitting devices; a plurality of first scan lines S1, S2, . . . , S2*n*−1, S2*n* arranged in a row direction; a plurality of emission control lines E1, E2, . . . , En−1, En arranged in the row direction; a plurality of data lines D1, D2, . . . , Dm−1, Dm arranged in a column direction; and a plurality of pixel power lines Vdd to supply pixel power. Here, the pixel power lines Vdd are connected to a first power line 130 and receives electric power from an external power source.

Further, data signals are transmitted through the data lines D1, D2, . . . , Dm−1, Dm to the pixels 110 in response to scan signals transmitted through the scan lines S1, S2, . . . , S2*n*−1, S2*n*, so that driving currents can be generated corresponding to the data signals. Also, a first transistor (not shown) provided in the pixel 110 generates a driving current corresponding to the data signal, and supplies the driving current to the light emitting device in response to the emission control signals transmitted through the emission control lines E1, E2, . . . , E*n*−1, En, thereby displaying an image. The number of emission control lines E1, E2, . . . , E*n*−1, En is equal to one half of the number of scan lines S1, S2, . . . , S2*n*−1, S2*n*.

The data driver 200 is connected to the data lines D1, D2, . . . D*m*−1, Dm and supplies the data signals to the pixel portion 100.

The scan driver 300 is provided on one side of the pixel portion 100, and connected to the plurality of scan lines S1, S2, . . . , S2*n*−1, S2*n* and the plurality of emission control lines E1, E2, . . . , En−1, En, thereby supplying the scan signals and the emission control signals to the pixel portion 100 in sequence. Thus, the rows of the pixel portion 100 are selected in sequence.

Here, one emission control line for supplying one emission control signal is connected with adjacent pixels respectively connected to two scan lines, so that two scan lines are sequentially selected by the scan signal, and then the pixels provided in two rows corresponding to the two scan lines are controlled to emit light at substantially the same time in response to one emission control signal.

Figure 3:
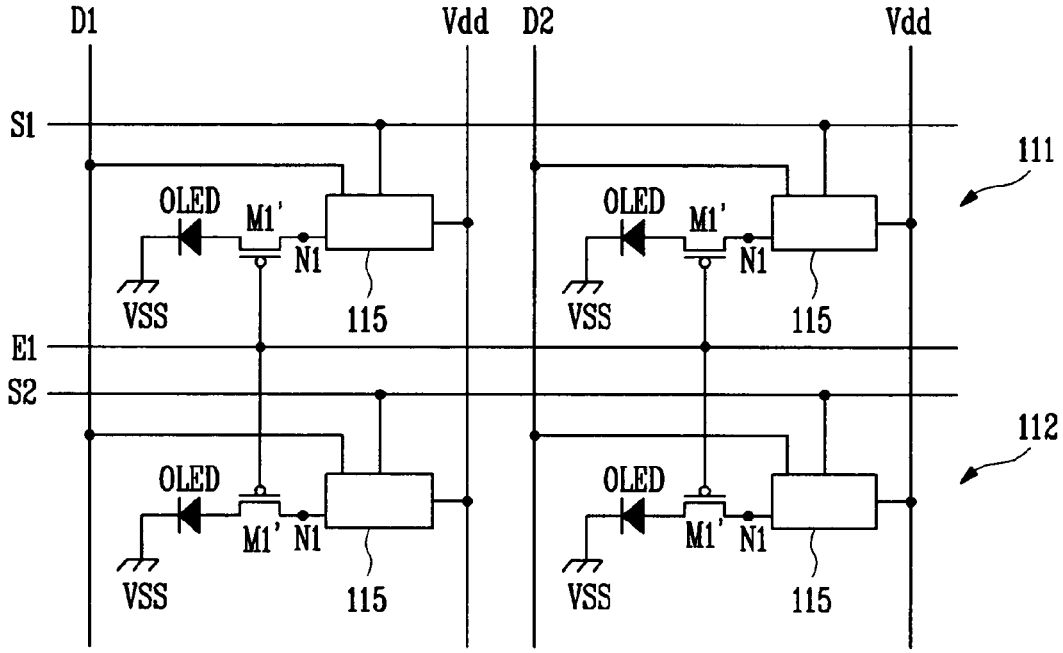
FIG. 3 is a circuit diagram of a pixel portion provided in the light emitting display according to the first exemplary embodiment of the present invention.

FIG. 3 is a circuit diagram of a pixel portion provided in the light emitting display according to the first exemplary embodiment of the present invention. As shown in FIG. 3, a plurality of pixels 111, 112 are arranged in the pixel portion. Each pixel includes a current generator 115, a first transistor M1' connected to the current generator 115, and a light emitting device OLED connected to the first transistor M1'. For example, the light emitting device OLED may be an organic light emitting device.

The current generator 115 periodically generates a current corresponding to the data signal when the scan signal, the data signal, and pixel power are respectively transmitted through the scan lines S1 and S2, the data lines D1 and D2, and the pixel power lines Vdd, thereby allowing the current to flow in a first node N1. Here, the current generator 115 may include a plurality of transistors and a capacitor.

Then, each first transistor M1' provided in two adjacent pixels connected to the same data line is connected to the same emission control line E1, and receives one emission control signal from the scan driver 300, so that the light emitting device OLED emits light according to operations of the first transistor M1'. At this time, one emission control signal is transmitted to two row lines, so that the light emitting devices OLED placed on two pixel rows emit light at substantially the same time.

Figure 4:
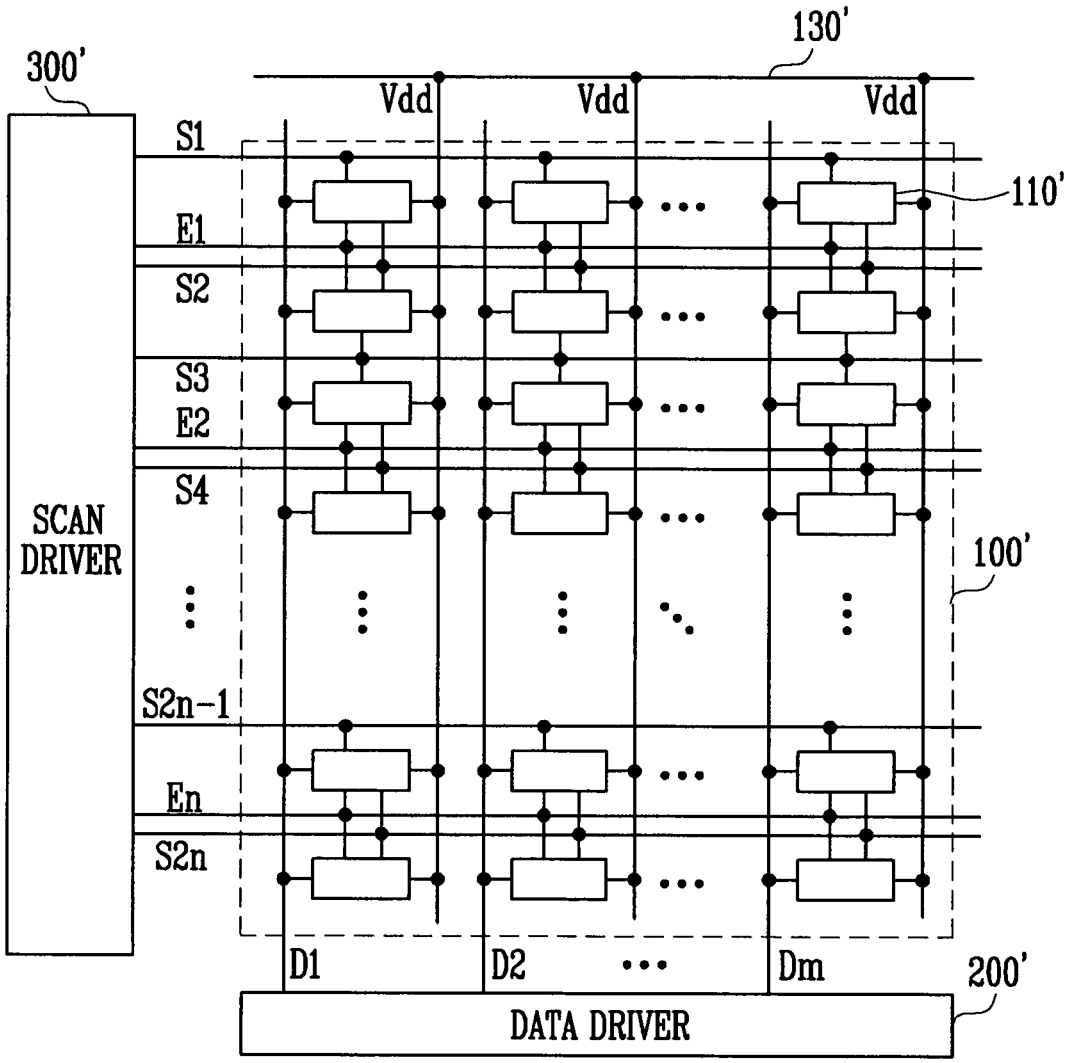
FIG. 4 illustrates a configuration of a light emitting display according to a second exemplary embodiment of the present invention.

FIG. 4 illustrates a configuration of a light emitting display according to a second exemplary embodiment of the present invention. Referring to FIG. 4, a light emitting display according to the second exemplary embodiment of the present invention includes a pixel portion 100', a data driver 200', and a scan driver 300.

The pixel portion 100' includes a plurality of pixels 110' each including light emitting devices; a plurality of first scan lines S1, S2, . . . , S2*n*−1, S2*n* arranged in a row direction; a plurality of emission control lines E1, E2, . . . , En−1, En arranged in the row direction; a plurality of data lines D1, D2, . . . , Dm−1, Dm arranged in a column direction; and a plurality of pixel power lines Vdd to supply pixel power. Here, the number of emission control lines is equal to one half of the number of scan lines. Further, the pixel power line Vdd is connected to a first power line 130 and receives electric power from an external power source.

The signals transmitted through the plurality of scan lines S1, S2, . . . , S2*n*−1, S2*n* are inputted to two rows of pixels. At this time, the pixels on one of the two rows receive the signal as an initialization signal to initialize the pixels, and the pixels on the other row receive the signal to make the data signals be transmitted to the pixels.

When the signal is used as the scan signal, data signals are transmitted from the data lines D1, D2, . . . , D*m*−1, Dm to the pixels 110' in response to the scan signals transmitted through the scan lines S1, S2, . . . , S2*n*−1, S2*n*, so that driving currents can be generated corresponding to the data signals. Also, a first transistor (not shown) provided in the pixel 110' generates a driving current corresponding to the data signal, and supplies the driving current to the light emitting device in response to the emission control signals transmitted through the emission control lines E1, E2, . . . , En−1, En, thereby displaying an image.

The data driver 200' is connected to the data lines D1, D2, . . . Dm−1, Dm and supplies the data signals to the pixel portion 100'.

The scan driver 300' is provided on one side of the pixel portion 100', and connected to the plurality of scan lines S1, S2, . . . , S2*n*−1, S2*n* and the plurality of the emission control lines E1, E2, . . . , En−1, En, thereby supplying the scan signals and the emission control signals to the pixel portion 100' in sequence. Thus, the rows of the pixel portion 100' are selected in sequence. In the scan driver 300', the number of output terminals to output the scan signals is twice as large as the number of output terminals to output the emission control signals.

Here, one emission control line for supplying one emission control signal is connected with adjacent pixels respectively connected to two scan lines, so that two scan lines are sequentially selected by the scan signals, and then the pixels provided on two rows are controlled to emit light at substantially the same time in response to one emission control signal.

Figure 5:
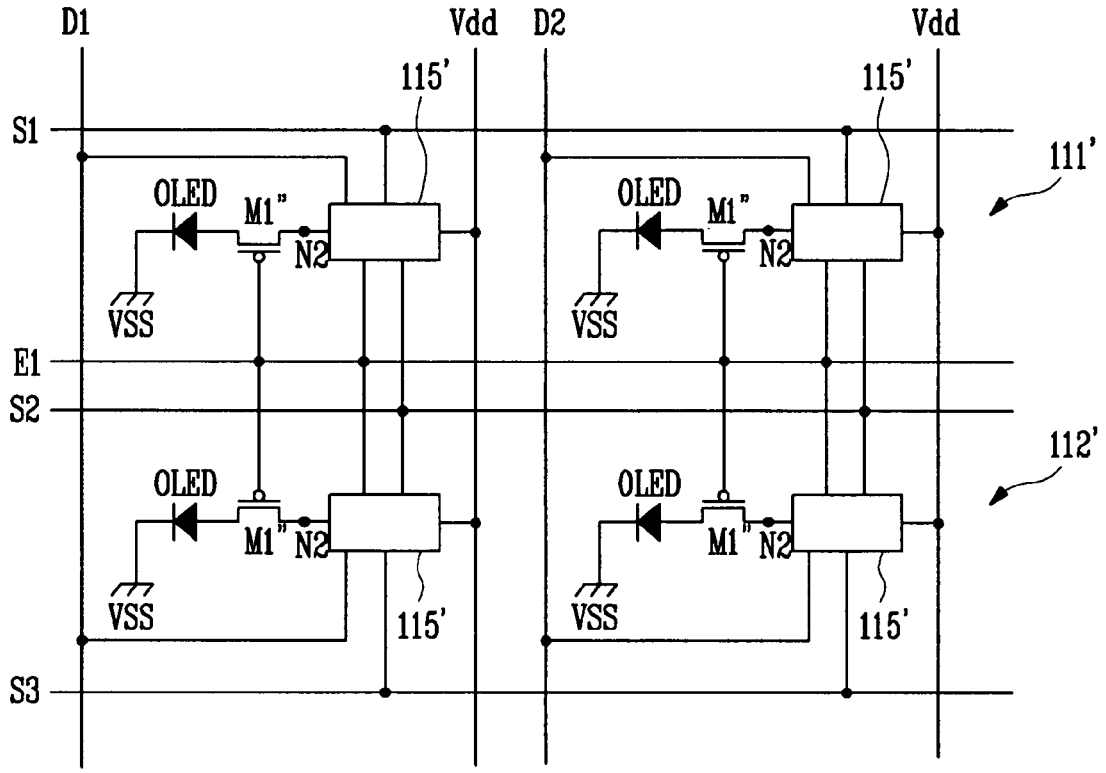
FIG. 5 is a circuit diagram of a pixel portion provided in the light emitting display according to the second exemplary embodiment of the present invention.

FIG. 5 is a circuit diagram of a pixel portion provided in the light emitting display according to the second exemplary embodiment of the present invention. As shown in FIG. 5, a plurality of pixels 111', 112' are arranged in the pixel portion. Each pixel includes a current generator 115', a first transistor M1" connected to the current generator 115', and a light emitting device OLED connected to the first transistor M1". For example, the light emitting device OLED is an organic light emitting device.

The current generator 115' periodically generates a current corresponding to the data signal when the scan signal, the emission control signal, the data signal, and pixel power are respectively transmitted through the scan lines S1 and S2, the emission control lines E1, the data lines D1 and D2, and the pixel power line Vdd, thereby allowing the current to flow in a first node N2. Here, the current generator 115' may include a plurality of transistors and a capacitor.

Then, each first transistor M1" provided in two adjacent pixels connected to the same data line is connected to the same emission control line E1, and receives one emission control signal from the scan driver 300', so that the light emitting device OLED emits light according to operations of the first transistor M1". At this time, one emission control signal is transmitted to two rows of pixels, so that the light emitting devices OLED placed on the two rows emit light at substantially the same time.

Figure 6:
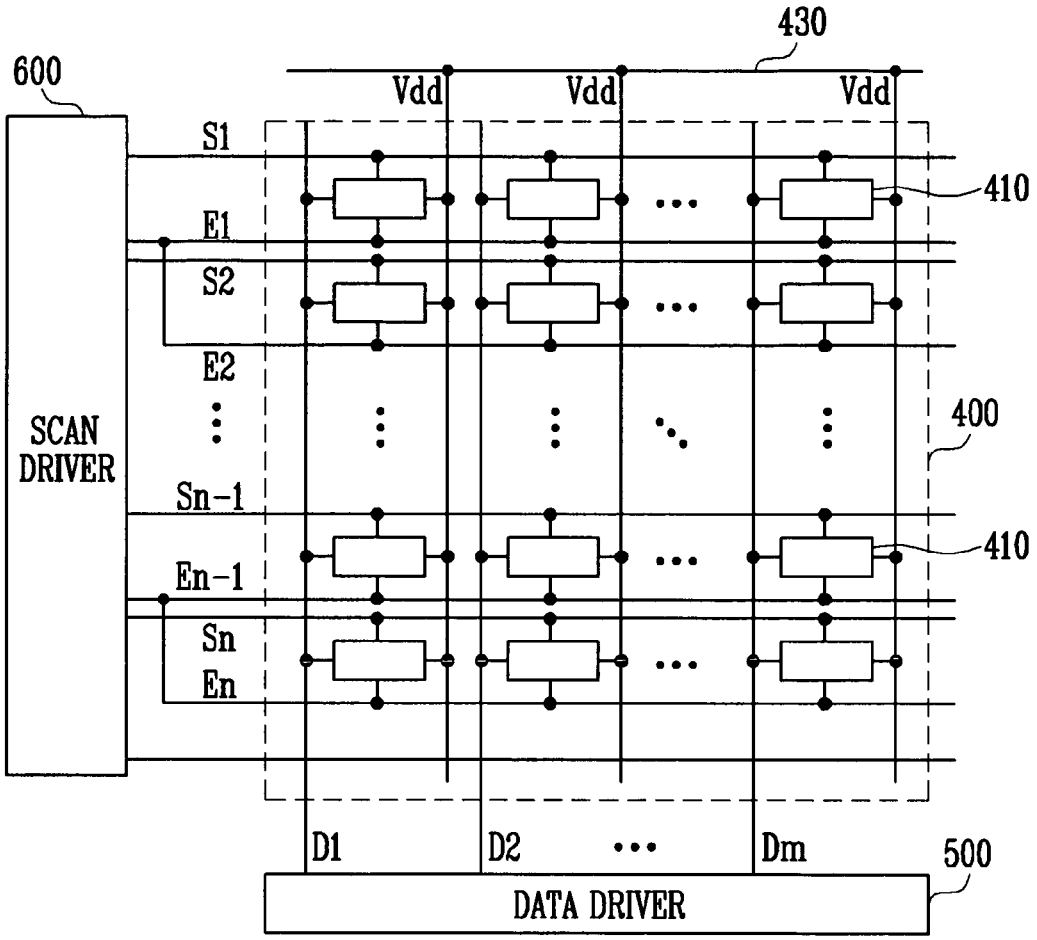
FIG. 6 illustrates a configuration of a light emitting display according to a third exemplary embodiment of the present invention.

FIG. 6 illustrates configuration of a light emitting display according to a third exemplary embodiment of the present invention. Referring to FIG. 6, a light emitting display according to the third exemplary embodiment of the present invention includes a pixel portion 400, a data driver 500, and a scan driver 600.

The pixel portion 400 includes a plurality of pixels 410 each including light emitting devices; a plurality of first scan lines S1, S2, . . . , Sn−1, Sn arranged in a row direction; a plurality of emission control lines E1, E2, . . . , En−1, En arranged in the row direction; a plurality of data lines D1, D2, . . . , Dm−1, Dm arranged in a column direction; and a plurality of pixel power lines Vdd to supply pixel power. Here, the pixel power line Vdd is connected to a first power line 430 and receives electric power from an external power source.

Further, data signals are transmitted from the data lines D1, D2, . . . , Dm−1, Dm to the pixels 110 in response to scan signals transmitted through the scan lines S1, S2, . . . , Sn−1, Sn, so that driving currents can be generated corresponding to the data signals. Also, a first transistor (not shown) provided in the pixel 410 generates a driving current corresponding to the data signal, and supplies the driving current to the light emitting device in response to the emission control signals transmitted through the emission control lines E1, E2, . . . , En−1, En, thereby displaying an image.

The data driver 500 is connected to the data lines D1, D2, . . . Dm−1, Dm and supplies the data signals to the pixel portion 400.

The scan driver 600 is provided on one side of the pixel portion 400, in which the output terminals to output the scan signals is twice as many as the output terminals to output the emission control signals. Here, one scan line is connected to one scan signal output terminal of the scan driver, and two emission control lines are connected to one emission control signal output terminal, so that the scan signal and the emission control signal are transmitted to the pixel portion 400 in sequence. That is, two adjacent pixels respectively connected to two different scan lines are connected to different emission control lines to which the same emission control signal is transmitted, thereby allowing two pixels to emit light at substantially the same time.

Figure 7:
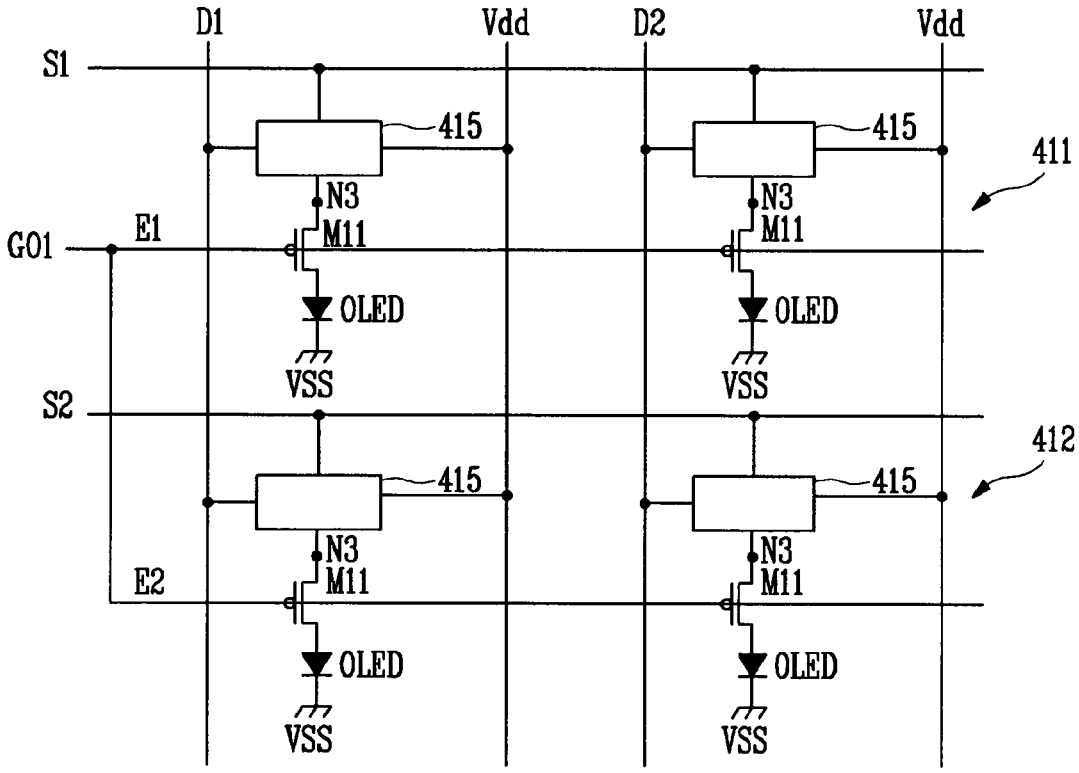
FIG. 7 is a circuit diagram of a pixel portion provided in the light emitting display according to the third exemplary embodiment of the present invention.

FIG. 7 is a circuit diagram of a pixel portion provided in the light emitting display according to the third exemplary embodiment of the present invention. The pixel portion includes a plurality of pixels 411, 412. As shown in FIG. 7, a current generator 415 periodically generates a current corresponding to the data signal when the scan signal, the data signal, and pixel power are respectively transmitted through the scan lines S1 and S2, the data lines D1 and D2, and the pixel power line Vdd, thereby allowing the current to flow in a first node N3. Here, the current generator 415 may include a plurality of transistors and a capacitor.

Here, one output terminal G01 of the scan driver 600 is connected with a pair of emission control lines E1 and E2. Therefore, the pair of emission control lines receives one emission control signal from the scan driver 600, and transmits the same emission control signal to a first transistor M11 connected with the pair of emission control lines.

Further, the light emitting device OLED emits light according to operations of the first transistor M11, and thus one emission control signal is transmitted to two rows of pixels, so that the light emitting devices OLED in the two rows of pixels emit light at substantially the same time.

Figure 8:
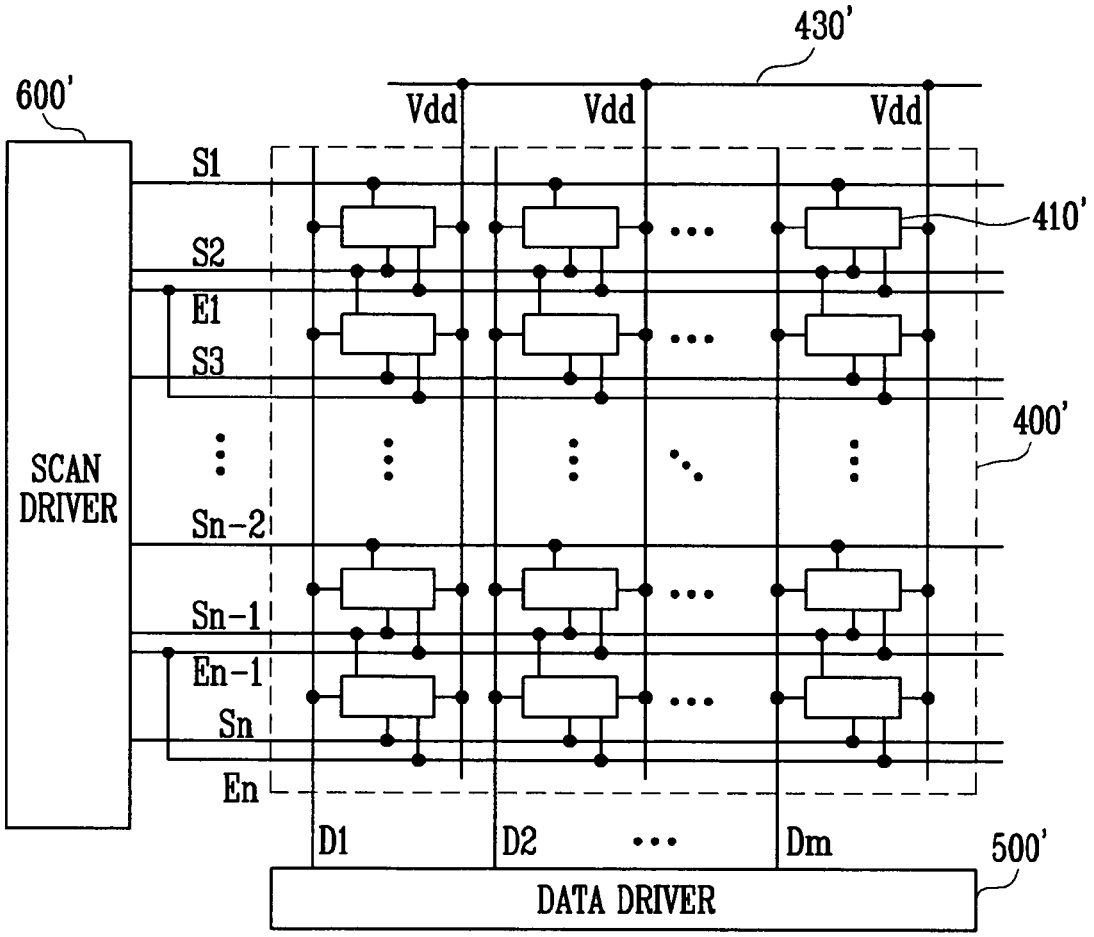
FIG. 8 illustrates a configuration of a light emitting display according to a fourth exemplary embodiment of the present invention.

FIG. 8 illustrates a configuration of a light emitting display according to a fourth exemplary embodiment of the present invention. Referring to FIG. 8, a light emitting display according to the fourth exemplary embodiment of the present invention includes a pixel portion 400', a data driver 500', and a scan driver 600'.

The pixel portion 400' includes a plurality of pixels 410' each including light emitting devices; a plurality of first scan lines S1, S2, . . . , Sn−1, Sn arranged in a row direction; a plurality of emission control lines E1, E2, . . . , En−1, En arranged in the row direction; a plurality of data lines D1, D2, . . . , Dm−1, Dm arranged in a column direction; and a plurality of pixel power lines Vdd to supply pixel power. Here, the pixel power line Vdd is connected to a first power line 430' and receives electric power from an external power source.

The signals transmitted through the plurality of scan lines S1, S2, . . . , Sn−1, Sn are inputted to two rows of pixels. At this time, pixels on one of the two rows receive the signal as an initialization signal to initialize the pixels, and the pixels on the other row receive the signal to make the data signals be transmitted to the pixels.

When the signal is used as the scan signal, data signals are transmitted from the data lines D1, D2, . . . , Dm−1, Dm to the pixels 410' in response to the scan signals transmitted through the scan lines S1, S2, . . . , Sn−1, Sn, so that driving currents can be generated corresponding to the data signals. Also, a first transistor (not shown) provided in the pixel 410' generates a driving current corresponding to the data signal, and supplies the driving current to the light emitting device in response to the emission control signals transmitted to the emission control lines E1, E2, . . . , En−1, En, thereby displaying an image.

The data driver 500' is connected to the data lines D1, D2, . . . Dm−1, Dm and supplies the data signals to the pixel portion 400'.

The scan driver 600' is provided on one side of the pixel portion 400'. The scan driver 600' has twice as many output terminals to output the scan signals as compared to output terminals to output the emission control signals. Here, one scan line is connected to one scan signal output terminal of the scan driver 600', and two emission control lines are connected to one emission control signal output terminal, so that the scan signal and the emission control signal are transmitted to the pixel portion 400' in sequence. That is, two adjacent pixels respectively connected to two different scan lines are connected to different emission control lines to which the same emission control signal is transmitted, thereby allowing two pixels to emit light at substantially the same time.

Figure 9:
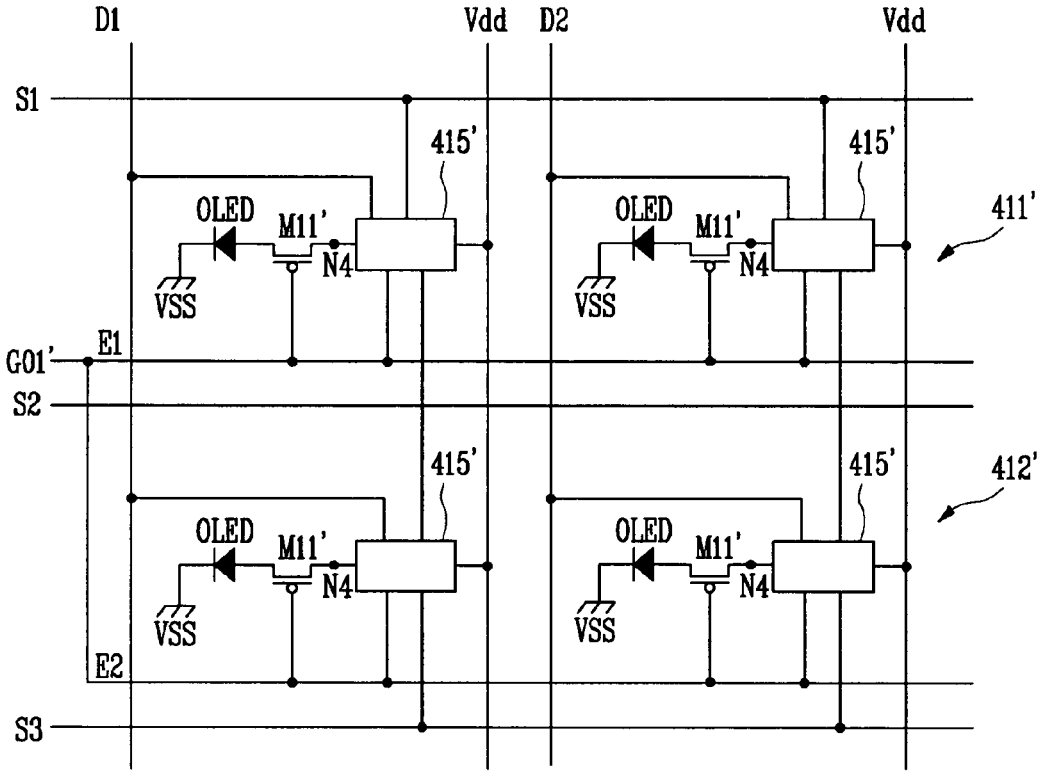
FIG. 9 is a circuit diagram of a pixel portion provided in the light emitting display according to the fourth exemplary embodiment of the present invention.

FIG. 9 is a circuit diagram of a pixel portion provided in the light emitting display according to the fourth exemplary embodiment of the present invention. As shown in FIG. 9, a current generator 415' periodically generates a current corresponding to the data signal when the scan signal, the emission control signal, the data signal, and pixel power are respectively transmitted through the scan lines S1 and S2, the emission control lines E1 and E2, the data lines D1 and D2, and the pixel power line Vdd, thereby allowing the current to flow in a first node N4. Here, the current generator 415' may include a plurality of transistors and a capacitor.

Here, one output terminal G01' of the scan driver 600' is connected to a pair of emission control lines E1 and E2. Therefore, the pair of emission control lines receives one emission control signal from the scan driver 600', and transmits the same emission control signal to a first transistor M11' connected with the pair of emission control lines.

Further, the light emitting device OLED emits light according to operations of the first transistor M11', and thus one emission control signal is transmitted to two rows of pixels, so that the light emitting devices OLED of the two rows of pixels emit light at substantially the same time.

Figure 10:
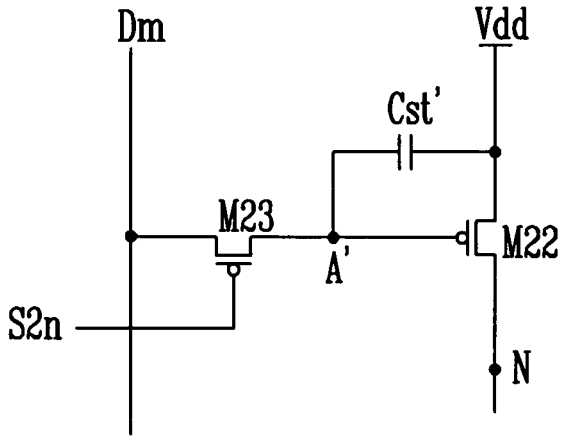
FIG. 10 is a circuit diagram of a first embodiment of a current generator according to an exemplary embodiment of the present invention.

FIG. 10 is a circuit diagram of a first embodiment of a current generator according to an exemplary embodiment of the present invention. By way of example, the current generator of FIG. 10 may be used as one or more of the current generators 115, 115', 415 and 415' of FIGS. 3, 5, 7 and 9. Referring to FIG. 10, the current generator includes a second transistor M22, a third transistor M23, and a capacitor Cst'. Here, each of the second transistor M22 and the third transistor M23 includes a gate, a source and a drain. Further, the capacitor Cst' includes a first electrode and a second electrode.

The second transistor M22 includes the source connected to a power line Vdd, the drain connected to a first node N, and the gate connected to a second node A'. Here, the second node A' is connected to the drain of the third transistor M23. The second transistor M22 supplies a current corresponding to the data signal to a light emitting device OLED.

The third transistor M23 includes the source connected to a data line Dm, the drain connected to the second node A', and the gate connected to a first scan line Sn. Here, the third transistor M23 supplies the data signal to the second node A' in response to a first selection signal transmitted to its gate. In this embodiment, n and m are arbitrary integers.

The capacitor Cst' includes the first electrode connected to the power line Vdd, and the second electrode connected to the first node A'. Here, the capacitor Cst' stores therein an electric charge corresponding to the data signal, and supplies the stored electric charge to the gate of the second transistor M22 for one frame, thereby maintaining an operation of the second transistor M22 for one frame.

Figure 11:
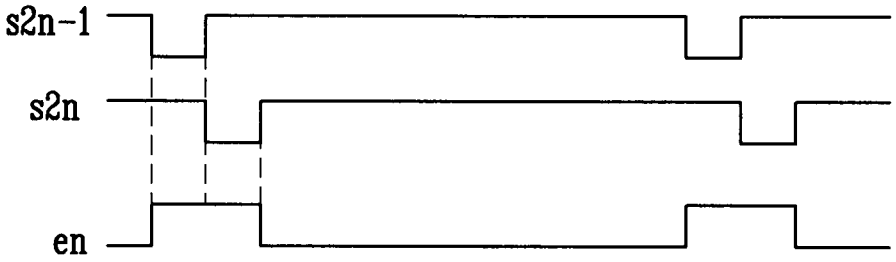
FIG. 11 shows an operational timing diagram of a pixel including the current generator illustrated in FIG. 10.

FIG. 11 shows an operational timing diagram of a pixel including the current generator illustrated in FIG. 10. Referring to FIGS. 3, 10 and 11, for example, the pixels are divided into a first (upper) pixel 111, and a second (lower) pixel 112, and every pixel is operated by a first scan signal s2*n*−1 transmitted to the current generator 115 of the first pixel 111, a second scan signal s2*n* transmitted to the current generator 115 of the second pixel 112, and an emission control signal en inputted through the first transistor M1'. In this example, the node N of FIG. 10 would correspond to the node N1 of FIG. 3.

When the first scan signal s2*n*−1 is changed from a high level signal to a low level signal but the second scan signal s2*n* and the emission control signal en are maintained at the high signal, the third transistor M23 is turned on, thereby supplying the data signal to the second node A'. At this time, the capacitor Cst' includes the first electrode connected to the pixel power line Vdd to receive the pixel power, and the second electrode connected to the second node A' to receive the voltage corresponding to the data signal. Therefore, the capacitor Cst' is charged with the voltage corresponding to a voltage difference between the pixel power and the data signal, thereby supplying the charged voltage to the gate of the second transistor M22. At this time, a current that can be represented by the following Equation 1 would flow from the source to the drain of the second transistor M22 if the current path is not interrupted.

$$I_{OLED} = \frac{\beta}{2}(Vgs - Vth)^2 - \frac{\beta}{2}(Vdata - Vdd - Vth)^2 \quad \text{[Equation 1]}$$

where $I_{OLED}$ is a current flowing in the light emitting device OLED; Vgs is a voltage applied between the source and the gate of the second transistor M22; Vdd is a voltage of the pixel power, Vth is a threshold voltage of the second transistor M22; and Vdata is a voltage corresponding to the data signal.

However, the emission control signal en is a high level signal, so that the first transistor M1' is turned off, thereby interrupting the current. As the current does not flow in the first pixel 111, the first pixel 111 does not emit light.

Further, when the second scan signal s2*n* is changed from a high level signal to a low level signal, the third transistor M23 is turned on, thereby supplying the data signal to the second node A'. At this time, the capacitor Cst' includes the first electrode connected to the pixel power line Vdd to receive the pixel power, and the second electrode connected to the second node A' to receive the data signal. Thus, the capacitor Cst' is charged with the voltage corresponding to a difference between the pixel power and the data signal, thereby supplying the charged voltage to the gate of the second transistor M22.

Therefore, the current that can be represented by the Equation 1 would flow from the source to the drain of the second transistor M22 if the current path is not interrupted.

However, the emission control signal en is a high level signal, so that the first transistor M1' is turned off, thereby interrupting the current. As the current does not flow in the second pixel 112, the second pixel 112 does not emit light.

Further, when the emission control signal en supplied through the emission control line En connected to the first pixel 111 and the second pixel 112 is changed to a low level signal, the current that can be represented by the Equation 1 flows in both the first pixel 111 and the second pixel 112, so that both the first and second pixels 111 and 112 emit light.

Figure 12:
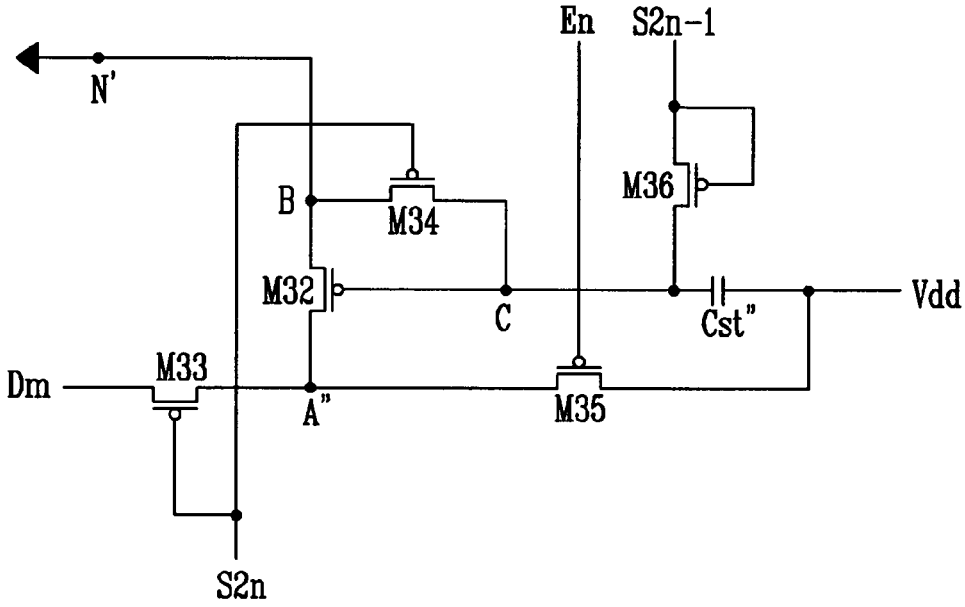
FIG. 12 is a circuit diagram of a second exemplary embodiment of a current generator according to an exemplary embodiment of the present invention.

FIG. 12 is a circuit diagram of a second embodiment of a current generator according to an exemplary embodiment of the present invention. By way of example, the current generator of FIG. 10 may be used as one or more of the current generators 115, 115', 415 and 415' of FIGS. 3, 5, 7 and 9, respectively. Referring to FIG. 12, the current generator includes second through sixth transistors M32, M33, M34, M35 and M36, and a capacitor Cst". Here, each of the second through sixth transistors M32 through M36 is a p-channel metal oxide semiconductor (PMOS) transistor, and includes a gate, a source and a drain. Further, the capacitor Cst" includes a first electrode and a second electrode. In the described embodiment, there may not be any physical differences between each drain and each source of the second through sixth transistors M32 through M36. Alternatively, the source, the drain and the gate may be referred to as first, second and third electrodes, respectively.

The current generator of FIG. 12 is connected to the first transistor M1', M1", M11 or M11' respectively of FIGS. 3, 5, 7 and 9 via a first node N'. Further, the emission control line En connected to the first transistor is connected to the current generator, thereby controlling the pixel power Vdd being inputted to the current generator using the emission control signal en.

The second transistor M32 includes the source connected to a second node A", the drain connected to a third node B, and the gate connected to a fourth node C, so that the current flows from the second node A" to the third node B according to voltages applied to the fourth node C.

The third transistor M33 includes the source connected to a data line Dm, the drain connected to the second node A", and the gate connected to a second scan line S2*n*. Here, the third transistor M33 selectively supplies the data signal to the second node A" through the data line Dm in response to a first scan signal s2*n* transmitted through the first scan line S2*n*.

The fourth transistor M34 includes the source connected to the third node B, the drain connected to the fourth node C, and the gate connected to the first scan line S2*n*. Here, the fourth transistor M34 makes the third node B and the fourth node C be substantially equipotential in response to the first scan signal s2*n* transmitted through the first scan line S2*n*, thereby allowing the second transistor M32 to be connected like a diode.

The fifth transistor M35 includes the source connected to the pixel power line Vdd, the drain connected to the second node A", and the gate connected to the emission control line En. Here, the fifth transistor M35 selectively supplies the pixel power to the second node A" in response to the first emission control signal en supplied through the emission control line En.

The sixth transistor M36 includes the source and the gate connected to the second scan line S2*n*−1, and the drain connected to the fourth node C, thereby supplying an initialization signal to the fourth node C. The initialization signal refers to a second scan signal s2*n*−1 inputted to the row prior to inputting the first scan signal s2*n*. Further, the second scan line S2*n*−1 refers to a scan line connected to a row of pixels to provide the second scan signal s2*n*−1 prior to providing the first scan signal s2*n* through the first scan line S2*n*.

The capacitor Cst" includes the first electrode connected to the pixel power line Vdd, and the second electrode connected to the fourth node C. Here, the capacitor Cst" is initialized by the initialization signal transmitted through the sixth transistor M36.

Figure 13:
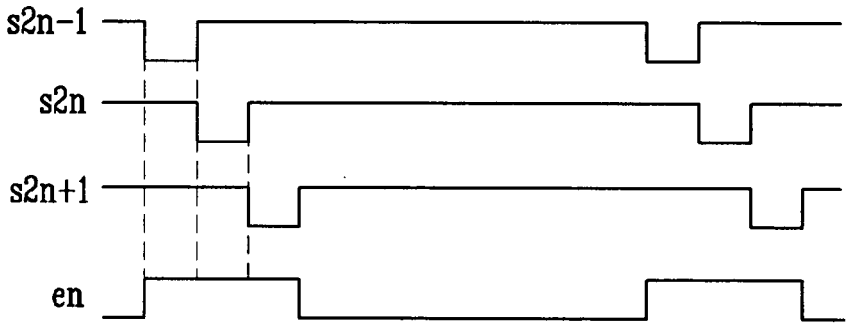
FIG. 13 shows an operational timing diagram of a pixel including the current generator illustrated in FIG. 12.

FIG. 13 shows an operational timing diagram of a pixel including the current generator illustrated in FIG. 12. Referring to FIGS. 5, 12 and 13, for example, the pixels are divided into a first (upper) pixel 111' and a second (lower) pixel 112', and every pixel is operated by a first scan signal s2*n*−1, a second scan signal s2*n* and a third scan signal s2*n*+1 that are transmitted to the current generators 115', and an emission control signal en inputted through the first transistor M1". Further, each pixel receives two scan signals.

When the first scan signal s2*n*−1 is changed from a high level signal to a low level signal but the second scan signal s2*n*, the third scan signal s2*n*+1 and the emission control signal en are maintained as the high level signal, the first pixel 111' is selected, and thus operated.

In the first pixel 111', when the sixth transistor M36 is turned on, the first scan signal s2*n*−1 is transmitted as the initialization signal to the fourth node C, thereby initializing the capacitor Cst". Then, when the second scan signal s2*n* is changed from a high level signal to a low level signal, and the emission control signal en is maintained as a high level signal, the third and fourth transistors M33 and M34 are turned on.

When the third transistor M33 and the fourth transistor M34 are turned on, the data signal is transmitted to the second node A" through the data line Dm, and the third node B and the fourth node C become substantially equipotential, so that the second transistor M32 is connected like a diode, thereby supplying the data signal from the second node A" to the fourth node C.

Thus, the capacitor Cst" is charged with voltage corresponding to the data signal, so that a voltage based on the following Equation 2 is applied between the gate and the source of the second transistor M32.

$$Vsg = Vdd - (Vdata - Vth) \quad \text{[Equation 2]}$$

Where Vsg is a voltage applied the source and the gate of the second transistor M32; Vdd is a pixel power voltage; Vdata is a voltage corresponding to the data signal; and Vth is the threshold voltage of the second transistor M32.

The capacitor Cst" is charged with a voltage corresponding to the data signal, and thus the voltage based on the Equation 2 is applied between the gate and the source of the second transistor M32.

However, the emission control signal en is maintained as a high level signal, thereby interrupting the current flowing from the source to the drain of the second transistor M32.

Further, when the second scan signal s2*n* is changed from a high level signal to a low level signal, the second scan signal s2*n* is inputted to the sixth transistor M36 of the second pixel 112', thereby initializing the capacitor Cst" of the second pixel 112'.

Also, when the second pixel 112' is selected by the third scan signal s2*n*+1, the third transistor M33 and the fourth transistor M34 are turned on. As the third and fourth transistors M33 and M34 are turned on, the data signal is transmitted to the second node A" through the data line Dm, the third node B and the fourth node C are substantially equipotential, and the second transistor M32 is connected like a diode, thereby transmitting the data signal from the second node A" to the fourth node C.

Therefore, the capacitor Cst" is charged with a voltage corresponding to the data signal, so that the voltage based on the foregoing Equation 2 is applied between the gate and the source of the second transistor M32.

Then, the emission control signal en is changed to a low level signal, maintained as the low level signal for a predetermined period, and inputted to the current generator, so that each fifth transistor M35 of the first pixel 111' and the second pixel 112' is turned on, thereby supplying the pixel power to the second node A". At this time, the voltage stored in the capacitor Cst" is transmitted to the gate of the second transistor M32, and the first transistor M31 is turned on by the emission control signal en while the fifth transistor M35 is turned on, so that the second transistor M32 controls the current to flow in both the first pixel 111' and the second pixel 112'. At this time, the current is calculated by the following Equation 3.

$$I_{OLED} = \frac{\beta}{2}(Vgs - Vth)^2 = \frac{\beta}{2}(Vdata - Vdd + Vth - Vth)^2 = \frac{\beta}{2}(Vdata - Vdd)^2 \quad \text{[Equation 3]}$$

where $I_{OLED}$ is a current flowing in the light emitting device OLED; Vgs is a voltage applied between the source and the gate of the second transistor M32; Vdd is a voltage of the pixel power, Vth is the threshold voltage of the second transistor M32; and Vdata is a voltage corresponding to the data signal.

Therefore, the current flows in the light emitting device OLED regardless of the threshold voltage of the second transistor M32.

Figure 14:
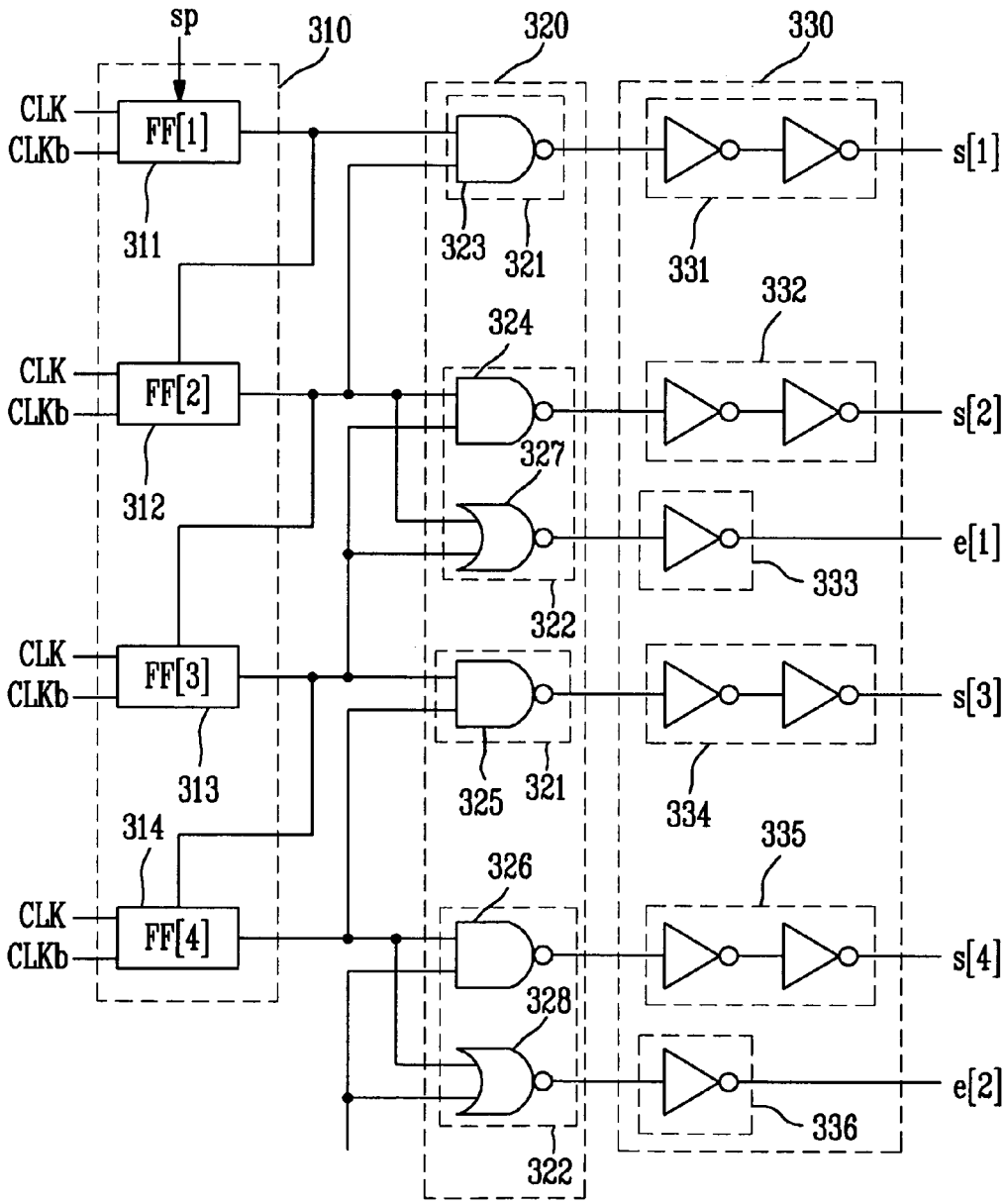
FIG. 14 illustrates a configuration of a scan driver provided in the light emitting display according to an exemplary embodiment of the present invention.

FIG. 14 illustrates a configuration of a scan driver provided in a light emitting display according to an exemplary embodiment of the present invention. The scan driver 300 of FIG. 14, for example, may be used as one or more of the scan drivers 300, 300', 600 and 600' of FIGS. 2, 4, 6 and 8, respectively.

Referring to FIG. 14, the scan driver includes a shift register 310, an operator 320, and a buffer 330.

The shift register 310 includes a plurality of flip-flops 311, 312, 313 and 314 (FF[1], FF[2], FF[3], FF[4]) connected in a column line, wherein an output signal is transmitted from a higher flip-flop 311 to a lower flip-flop 312, and the lower flip-flop 312 shifts the output signal of the higher flip-flop 311.

Hereinbelow, some flip-flops of the shift register 310 will be exemplarily described, and the flip-flops will be called a first flip-flop 311, a second flip-flop 312, a third flip-flop 313, and a fourth flip-flop 314 from the topmost flip-flop to the bottommost flip-flop in order.

The first flip-flop 311 receives a start pulse sp and shifts the start pulse sp into the shift signal, thereby outputting the shift signal to the second flip-flop 312 and the operator 320. Further, the second flip-flop 312 receives the shift signal from the first flip-flop 311, and outputs it to the third flip-flop 313 and the operator 320. Further, the third flip-flop 313 receives the shift signal from the second flip-flop 312, and outputs it to the fourth flip-flop 314 and the operator 320. Further, the fourth flip-flop 314 receives the signal from the third flip-flop 313 and outputs it to the lower flip-flop (not shown) and the operator 320.

The operator 320 includes a first operator 321 having a NAND gate, and a second operator 322 having a NAND gate and a NOR gate, wherein the first operator 321 and the second operator 322 are alternately formed. Hereinbelow, each NAND gate and each NOR gate of the first operator 321 and the second operator 322 will be called a first NAND gate 323, a second NAND gate 324, a third NAND gate 325, a fourth NAND gate 326, a first NOR gate 327, and a second NOR gate 328 from the topmost NAND or NOR gate to the bottommost NAND or NOR gate in order.

The first NAND gate 323 receives the signals from the first flip-flop 311 and the second flip-flop 312 and performs a NAND operation, thereby forming a first scan signal s[1]. The second NAND gate 324 receives the signals from the second flip-flop 312 and the third flip-flop 313 and performs the NAND operation, thereby forming a second scan signal s[2]. The third NAND gate 325 receives the signals from the third flip-flop 313 and the fourth flip-flop 314 and performs the NAND operation, thereby forming a third scan signal s[3]. The fourth NAND gate 326 receives the signals from the fourth flip-flop 314 and a lower flip-flop (not shown) and performs the NAND operation, thereby forming a fourth scan signal s[4].

Further, the first NOR gate 327 receives the signals from the second flip-flop 312 and the third flip-flop 313 and performs a NOR operation, thereby forming a first emission control signal e[1], and the second NOR gate 328 receives the signals from the fourth flip-flop 314 and the lower flip-flop (not shown) and performs the NOR operation, thereby forming a second emission control signal e[2].

Therefore, the first operator 321 including the NAND gate generates only the scan signal. Further, the second operator 322 including the NAND gate and the NOR gate generates the scan signal and the emission control signal.

The buffer 330 includes first through sixth buffers 331, 332, 333, 334, 335 and 336 from the topmost buffer to the bottommost buffer in order. Here, each of the first buffer 331, the second buffer 332, the fourth buffer 334, and the fifth buffer 335 includes two inverters connected in series, thereby enhancing driving efficiency of the scan signal. Further, each of the third buffer 333 and the sixth buffer 336 includes one inverter, thereby enhancing the driving efficiency of the emission control signal.

In the scan driver with this configuration, the number of output terminals to output the emission control signals decreases as compared with the number of output terminals to output the scan signals, so that the number of the output terminals in the scan driver decreases, thereby reducing the size of the scan driver.

Figure 15:
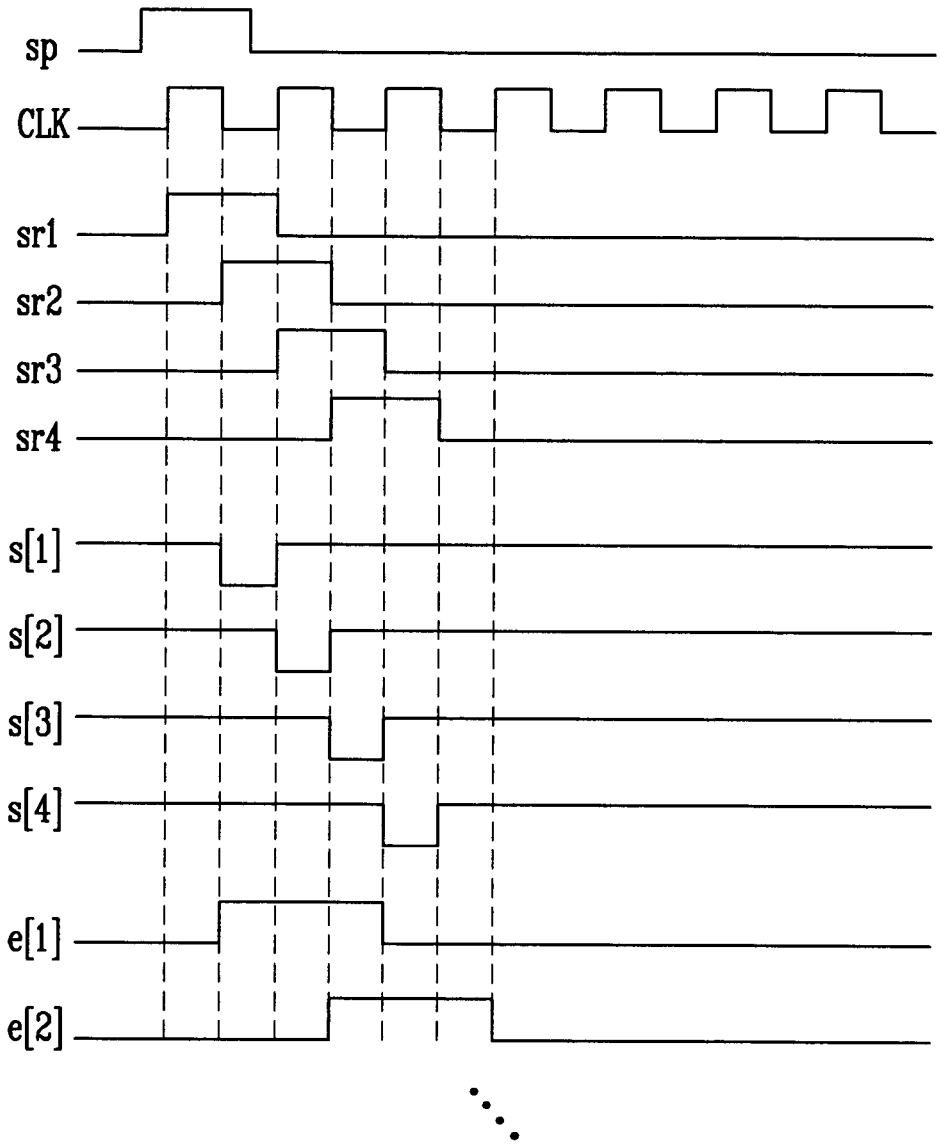
FIG. 15 shows an operation timing diagram of the scan driver illustrated in FIG. 14.

FIG. 15 shows an operational timing diagram of the scan driver illustrated in FIG. 14. Referring to FIG. 15, in a state where a clock signal is inputted to each flip-flop of the shift register 310, when the start pulse sp is inputted to the first flip-flop 311, the first flip-flop 311 shifts the start pulse sp and outputs a first shift signal sr1 when the clock signal rises. Then, the first shift signal sr1 is inputted to the second flip-flop 312, and the second flip-flop 312 shifts the first shift signal sr1 and outputs a second shift signal sr2 when the clock signal falls.

At this time, the first NAND gate 323 receives the first and second shift signals sr1 and sr2 and performs the NAND operation, thereby generating the first scan signal s[1]. Further, the second NAND gate 324 receives the second and third shift signals sr2 and sr3 and perform the NAND operation, thereby generating the second scan signal s[2]. Further, the third NAND gate 325 receives the third and fourth shift signals sr3 and sr4 and perform the NAND operation, thereby generating the third scan signal s[3]. Further, the fourth NAND gate 326 receives the fourth shift signal sr4 and the fifth shift signal (not shown), thereby generating the second scan signal s[4].

Also, the first NOR gate 327 receives the second shift signal sr2 and the third shift signal sr3 and performs the NOR operation, thereby generating the first emission control signal e[1]. Further, the second NOR gate 328 receives the fourth shift signal sr4 and the fifth shift signal and performs the NOR operation, thereby generating the second emission control signal e[2].

As described above, the described embodiments of the present invention provide a scan driver, a light emitting display including the same, and a driving method thereof, in which one emission control line is shared by pixels provided on two adjacent rows, so that the number of wiring lines provided in a pixel portion is decreased, thereby enhancing an aperture ratio.

Further, because one emission control signal transmitted through the one emission control line is used for the pixels provided on two adjacent rows, the number of emission control signals outputted from the scan driver is reduced, thereby decreasing the number of components and wiring lines needed for the scan driver, and simplifying the fabrication process. Moreover, the size of the scan driver is decreased, thereby reducing the size of the light emitting display. Also, the scan driver consumes less power, thereby reducing the power consumption of the light emitting display.

Although a few exemplary embodiments of the present invention have been shown and described, it would be appreciated by those skilled in the art that changes might be made in the described embodiments without departing from the principles and spirit of the invention, the scope of which is defined in the claims and their equivalents.

What is claimed is:

1. A scan driver comprising:

a shift register adapted to shift an input starting signal and output a plurality of shift signals to a plurality of output lines in sequence;

a plurality of first operators coupled to the plurality of output lines of the shift register and for using the shift signals to generate scan signals; and a plurality of second operators coupled to the plurality of output lines of the shift register and for generating the scan signals and emission control signals by using the shift signals, wherein the first operators and the second operators are alternately coupled to the plurality of output lines, wherein at least one of the first operators comprises a NAND gate for using a first shift signal of the shift signals and a second shift signal of the shift signals as input signals, and wherein at least one of the second operators comprises a NAND gate for using the second shift signal and a third shift signal of the shift signals as input signals, and a NOR gate for using the second shift signal and the third shift signal as input signals.

2. The scan driver according to claim 1, wherein at least one of the first operators is coupled to a first buffer to enhance driving efficiency of the scan signals, and at least one of the second operators is coupled to a second buffer to enhance driving efficiency of the emission control signals.

3. The scan driver according to claim 1, wherein the shift register is adapted to receive a clock signal and shift the input starting signal in accordance with the clock signal, a frequency of the clock signal being different from those of the emission control signals.

4. A scan driver comprising:

a shift register adapted to shift an input starting signal and output a plurality of shift signals to a plurality of output lines in sequence;

a plurality of first operators coupled to the plurality of output lines of the shift register and for using the shift signals to generate scan signals; and a plurality of second operators coupled to the plurality of output lines of the shift register and for generating the scan signals and emission control signals by using the shift signals, wherein the first operators and the second operators are alternately coupled to the plurality of output lines, wherein at least one of the first operators is coupled to a first buffer to enhance driving efficiency of the scan signals, and at least one of the second operators is coupled to a second buffer to enhance driving efficiency of the emission control signals, and wherein the first buffer comprises an even number of inverters, and the second buffer comprises an odd number of inverters.

5. The scan driver according to claim 4, wherein the shift register is adapted to receive a clock signal and shift the input starting signal in accordance with the clock signal, a frequency of the clock signal being different from those of the emission control signals.

* * * * *